US006341392B1

(12) United States Patent
Mäkinen

(10) Patent No.: US 6,341,392 B1
(45) Date of Patent: Jan. 29, 2002

(54) SOFA BED

(75) Inventor: Auvo Mäkinen, Vanhalinna (FI)

(73) Assignee: I. S. Mäkinen Oy, Vanhalinna (FI)

( * ) Notice: Subject to any disclaimer, the term of this patent is extended or adjusted under 35 U.S.C. 154(b) by 0 days.

(21) Appl. No.: 09/428,531

(22) Filed: Oct. 28, 1999

(51) Int. Cl.[7] ..... A47C 17/16; A47C 17/165
(52) U.S. Cl. ..... 5/47; 5/43
(58) Field of Search ..... 5/43, 47, 48, 37.1

(56) References Cited

U.S. PATENT DOCUMENTS

| | | | | | |
|---|---|---|---|---|---|
| 2,664,574 | A | * | 1/1954 | Newborn | 5/43 |
| 3,905,053 | A | * | 9/1975 | Vuchelich | 5/43 |
| 4,590,630 | A | | 5/1986 | Barabas | 5/13 |
| 4,829,611 | A | | 5/1989 | Fireman et al. | 5/47 |
| 5,097,544 | A | | 3/1992 | Barabas | 5/13 |
| 5,195,194 | A | | 3/1993 | Bradley et al. | 5/37.1 |
| 5,249,317 | A | | 10/1993 | Farlow | 5/37.1 |
| 5,271,109 | A | | 12/1993 | Markel et al. | 5/37.1 |
| 5,664,268 | A | | 9/1997 | Stoler et al. | 5/47 |
| 5,913,770 | A | | 6/1999 | Tseng | 5/41 |

FOREIGN PATENT DOCUMENTS

| | | | | |
|---|---|---|---|---|
| AT | 162992 | * | 4/1949 | 5/43 |
| EP | 943264 A1 | | 9/1999 | |
| EP | 0943268 A1 | | 9/1999 | |
| FR | 2733887 | | 11/1996 | |
| GB | 2070423 A | | 9/1981 | |
| NO | 59199 | | 4/1938 | |
| NO | 99587 | | 3/1962 | |
| SE | 98998 | * | 3/1940 | 5/43 |
| SE | 153191 | * | 1/1956 | 5/43 |

* cited by examiner

*Primary Examiner*—Alexander Grosz
(74) *Attorney, Agent, or Firm*—Nixon & Vanderhye P.C.

(57) ABSTRACT

The object of the invention is a sofa bed (1) which can be used in sofa position and in bed position, and which sofa bed (1) comprises a frame (2) which comprises end sections (3,5), a seating section (9) connected to the frame (2), and a back section (7), which is pivotally connected to the frame (2) in at least two turning points and which comprises a back side (45) of the sofa at the end sections (3,5) of which is a turning guide (25) and preferably upwards orienting directing guide (27) and which turning guide (25) and directing guide (27) are generally elongated in form and substantially at an angle with each other a first turning point is arranged to travel back and forth the turning guide (25) and a second turning point in cross direction in a distance from the first turning point, is arranged to travel back and forth the directing guide (27) in order to change the position of the back section (7) between the sofa position and bed position and to turn the back side (45) of the back section (7) upwards.

13 Claims, 7 Drawing Sheets

SOFA BED

BACKGROUND

The present invention relates to a sofa bed, which sofa bed can be used in sofa position or bed position.

The sofa bed according to the invention suits especially well to be used in places in which, e.g. because of the lack of space in the room, a separate sofa and bed cannot be placed. Thus, a piece of furniture that is used as a sofa during the daytime can be changed into a bed and the furnishing of a room is made comfortable and easy to change. In this connection, the sofa bed means a furniture that can be used as well as a seat and a bed. Such a furniture is, e.g. all sorts of sofas and chairs that can be opened and folded.

At present a plurality of various sofa-bed arrangements are known which, according to their opening direction, and thus according to their sleeping direction, can be divided into sofa beds parallel with the back rest, i.e., longitudinal sofa beds, and into sofa beds perpendicular to the back rest, i.e., transversal sofa beds.

Longitudinal sofa beds are disclosed, e.g., in U.S. patent publications U.S. Pat. No. 5,271,109 and U.S. Pat. No. 5,249,317 and in a French patent publication FR 2 733 887. In the publication U.S. Pat. No. 5,271,109 a longitudinal sofa bed is carried out by means of a folding back rest, so that a bed section is formed of a seating section and a backwards lowered back rest. In the publication U.S. Pat. No. 5,249,317 a longitudinal sofa bed is formed by lowering into the bed level together joined seating section and front and back parts of the back rest forming the back rest.

In the sofa disclosed in the publication FR 2 733 887, the back rest includes a sliding support part, the lifting of which relieves the end section of the seating section, which thus serves as a bed with the rest of the seating section.

Transversal sofa beds are disclosed, e.g., in U.S. Pat. No. 4,590,630 and U.S. Pat. No. 5,097,544 as well as in GB 2 070 423 and EP 0 943 268. In the arrangements disclosed in U.S. Pat. No. 4,590,630 and U.S. Pat. No. 5,097,544 a bed section can be folded inside the frame of the sofa. In the arrangement disclosed in GB 2 070 423, a sofa is changed into a bed by lowering down a back rest connected to a seating section and by lifting the bottom part of the seating section as an extension to a thus formed surface. In the arrangement disclosed in EP 0 943 268, a bed is changed into a sofa by pulling the seating sections outwards from below the back rest in which case the back rest remains in its position partly above the bed section.

The most difficult problem in the known arrangements, especially in the longitudinal beds, is their complex structure. The use of sofa beds comprising a large number of hinges, turnable parts or removable pieces is thus often difficult. Especially in common use, e.g. in hotels and ships, unaccustomed users may easily break the mechanisms of the sofas when using these sofa beds. In addition, unaccustomed users may even hurt themselves, e.g. by leaving their fingers between the folding hinges. Due to the complex structure, the known sofa bed arrangements are often also much more expensive to manufacture than ordinary sofas, so it has not been profitable to acquire a sofa bed for only to be used occasionally as a spare bed without a regular need. Furthermore, due to the complexity of the known arrangements, the structure of sofa beds is very heavy, which impedes the transportation and moving of the sofa bed.

In addition, one problem of the known arrangements is their substantial need of space. Changing a sofa into a normal-size double bed, that is, into a bed having a length of 200 centimeters and a width of 160 centimeters, has been a problem in the known arrangements, especially when using the sofa in a small space. The problem associated with transversal beds is that folding or otherwise closing of the bed section would require too much space as a part of the structure of the sofa or inside the sofa. The problem associated with longitudinal sofa beds is caused by the fact that in the known arrangements, due to a space required by the folding of the back rest, a useless space is left between the wall and the bed section. In addition, in order to achieve a maximal width of the bed, the seating depth of the sofa had to be widened, whereupon the sitting comfort has suffered.

Yet another problem associated especially with the transversal sofa beds is, that in connection with the sofa bed, e.g. inside the sofa bed, there is no stowage room for, e.g. bedclothing, because of a substantial amount of space required by the mechanism of the sofa bed.

SUMMARY OF THE INVENTION

It is an object of the present invention to provide a better sofa bed than previous ones.

The intention is thus to provide a sofa bed which can be opened to form a longitudinal bed by turning the back section of the sofa forward towards the seating section in which case the back of the back section serves as a bed surface preferably together with the seating section.

The intention is thus to provide a sofa bed which can be placed in close proximity to a wall and opened to a bed position without moving the sofa bed off the wall.

It is also desirable to provide a sofa bed that is simple and easy to use.

It is an object to provide a sofa bed which can be opened to a bed position and thus provide a longitudinal full-size sofa bed to substitute even a bed.

It is another object to provide a sofa bed inside the frame of which a space is left to be used for stowage room, e.g., for bedclothing.

It is still another object to provide a sofa bed on the back side of the back section of which the bedclothing can be attached, thus being easy to take into use when opening the sofa to a bed.

The sofa bed according to the invention, which sofa bed can be used in a sofa position and bed position, comprises typically a frame comprising end sections, a seating section connected to the frame, and a back section pivotally connected to the frame in at least two turning points, the back section comprising a front that serves as a back rest of the sofa, and a back side of the sofa. In this connection, the frame means all such constructions that, as regards their structure or other properties, can be used as a support structure of the sofa bed. Such constructions suitable for a frame are, e.g., different ribbings made of metal, plastic, wood or the like, or elements or constructions mounted of parts, such as tubes, connected to each other. The frame includes also the constructions surrounding the sofa bed, such as, e.g., the walls of the building in the case that the seating section and the back section can be attached directly to them. The sofa bed can also comprise more than one frame. In this connection, the end section means the area or construction at the end sections of the frame, such as, e.g. the short sides of the frame ribbing, which, e.g. form or to which the end plates of the sofa are attached. The turning point means, in this connection, a point around which a movement of some part of the sofa bed, e.g. of the back section, takes place.

In the end sections of the sofa bed according to the invention, is a turning guide and a substantially upwards orienting directing guide, which turning guide and directing guide are generally elongated in form and substantially at an angle with each other. In this connection, turning guide and directing guide mean an element that serves as a guide for the movement of the turning point of the sofa bed. The turning guide and directing guide can be different from each other and their structure can be, e.g. groove-, tube-, slot-, track- or bar-like and they can be made, e.g. of metal, wood, plastic or of some other material suitable for the purpose. The turning guide and directing guide can be bent or curved as well as joined together, e.g. by welding, but there is an angle between their general forms. The substantially upwards orientation of the directing guide means, in this connection, that the direction of the directing guide deviates substantially from the horizontal plane. The guides can be fixed parts of the end sections or of other structural parts or, if desired, they can be removably attached to them. The guides can also by themselves form an end section of the sofa bed. The first turning point of the back section is arranged to travel back and forth the turning guide and the second turning point located in cross direction in a distance from the first turning point is arranged to travel back and forth the directing guide, preferably in both ends of the sofa bed, in order to change the position of the back section between the sofa position and bed position. Due to the angle between the turning guide and directing guide, the turning points have substantially different paths. The passage of the turning points in the guides can be carried out, e.g. by means of supporting elements located in the back section or connected to the back section. Such supporting elements are, e.g. different rolls, wheels, bearings, glides, axis or pegs that can be in immediate connection to the back section or in some distance from the back section. The purpose of the directing guide is to prevent the furthest part of the turning back section from travelling further than the furthest part of the sofa bed in sitting position. In order to render the turning of the back section, the first turning point of the back section has to manage simultaneously to move along the rail deviating from the direction of the directing guide, that is, along the turning guide. The sofa bed can also have other directing elements of the back section.

In a preferred sofa bed according to the invention the seating section is arranged movably so that the seating section can be moved away from beneath the back section or the seating section can be moved to utilize the seating section as a bed surface. The movability of the seating section means, in this connection, that the seating section can be moved by lifting, lowering, pulling or pushing by hands or by means of an element, such as a spring or a cylinder. The bed surface means, in this connection, the level which is used as a bed, e.g. as a sleeping mat, including cushions for the sake of comfort.

In a preferred sofa bed according to the invention the first turning point is located in the side of the seating section of the back section with respect to the vertical middle line of the back section in sofa position, in which case the turning movement of the back section is reliable and less force is needed in the turning movement. In a preferred sofa bed according to the invention the first and the second turning point are located substantially below the seat and bed surface, in which case above the seat and bed surface there are no parts left to interfere the use or the planning of the sofa bed and the sofa bed is more comfortable to use.

In a preferred sofa bed according to the invention, a turning support element that is arranged to travel back and forth in the turning guide, is connected to the back section, which turning support element comprises a supporting arm and a moving member connected to the support arm and which is arranged to render the movement and turning of the turning support element. By means of the turning support element the turning point of the back section can be moved further from the actual back section, in which case the location of the turning points does not have to be considered so carefully in the planning of the back section, and thus the seating section is made less complex and less heavy in structure.

In a preferred sofa bed according to the invention, a directing support element that is arranged to travel back and forth in the directing guide, is connected to the back section, which directing support element comprises a supporting arm and a moving member connected to the supporting arm and which is arranged to render the movement and turning of the directing support element. By means of the directing support element the turning point of the back section can moved further from the actual back section, in which case the location of the turning points does not have to be considered so carefully in the planning of the back section, and thus the back section is made less complex and less heavy in structure.

In a preferred sofa bed according to the invention, preferably at the end sections of it, is a limiter to limit the extreme positions of the back section, whereupon the sofa bed is steady and safe in both sofa position and bed position.

In a preferred sofa bed according to the invention the back section is arranged to pivot about its turning points so, that the back side of the back section is to be changed to a bed surface of a bed, in which case the cushioned back side of the back section suits as such to serve as a bed.

In a preferred sofa bed according to the invention the back side of the back section together with a first side of the seating section is to be arranged to a full-size bed surface of a bed, in which case the bed surface is big enough for several, preferably for two users. The full-size, in this connection, means the length and the width of the bed surface, which suit for a normal-size person, that is typically at least 180 centimeters in length and 140 centimeters in width and preferably at least 200 centimeters in length and 160 centimeters in width.

In a preferred sofa bed according to the invention, an overlay mattress to be used in bed position is attached to the back side of the back section, which speeds up the making of the bed and arranging it ready for use.

The greatest advantage of the invention described above is, that the sofa bed according to the invention can be placed in close proximity to a wall and it is not necessary to leave an empty space requiring space between the bed and the wall nor is it necessarily formed.

In addition, one advantage of the invention is, that the whole length of the back side of the back section can be utilized as a bed surface, in which case the width of the bed can be increased easily by increasing the height of the back rest so that the sitting comfort of the sofa does not suffer. Furthermore, when using the back side of the back section as a bed surface, the back rest can be decorated or designed as regards the furnishing or in order to achieve sitting comfort so that the using comfort of the sofa does not suffer.

In addition, the advantage of an embodiment of the invention is, that, as a result of a minor need of space of the mechanisms of the back section and seating section of the sofa bed, an empty space is left inside the frame, which space can be used as a stowage room. Furthermore, the mechanisms left below the sitting surface in the edges of the frame cannot consideraby limit designing of the sofa bed, which makes various different choices possible for the structure of the sofa bed according to the invention.

A further advantage of the invention is the simple, economic and durable structure.

A further advantage of the invention is, that when turning the sofa bed from sofa position to bed position, the sofa bed has no removable or transferable parts that would require extra room for stowage.

BRIEF DESCRIPTION OF THE DRAWINGS

The invention will be described herein with reference to the accompanying drawings wherein.

DETAILED DESCRIPTION OF PREFERRED EMBODIMENTS

Figure 1:
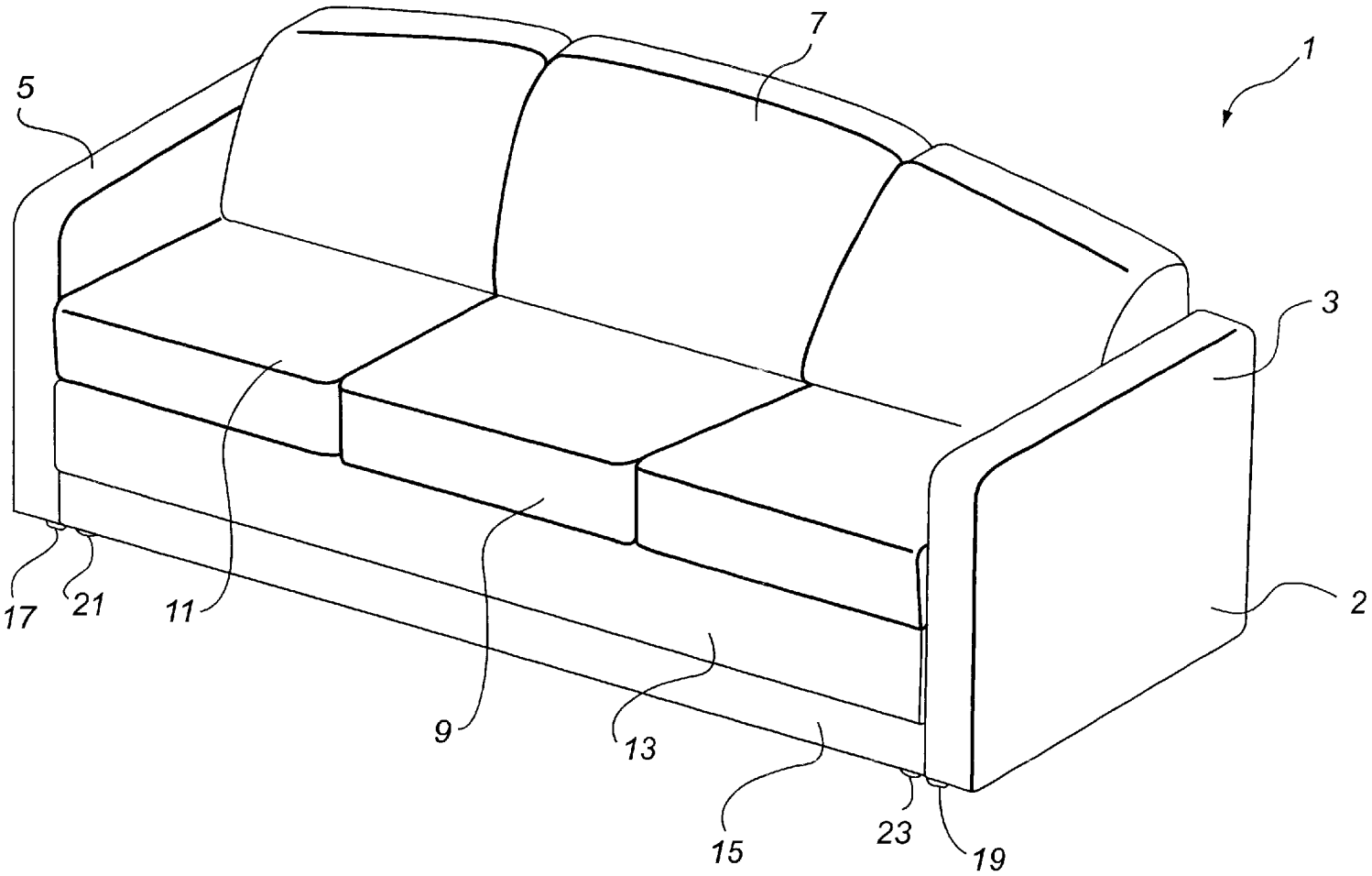
FIG. 1 shows schematically and as an example a perspective view of the sofa bed according to the invention.

FIG. 1 shows as an example an obliquely upwards view of the sofa bed according to the invention. The sofa bed 1 comprises a frame 2 which includes the end sections 3 and 5. The back section 7 and the seating section 9 are connected to the end sections 3 and 5. The back section 7 is a uniform piece the appearance of which reminds of removable back pads due to the upholstery of the back section 7. The seating section 9 is also a uniform piece comprising seat cushions 11 as well as their upholstery which gives the seating section an appearance of removable seat pads. The seating section 9 comprises also the front part 13 and the upholstery 15 of the seating section 9. The support elements 17 and 19 of the frame as well as the support legs 21 and 23 are located below the sofa bed 1.

Figure 2:
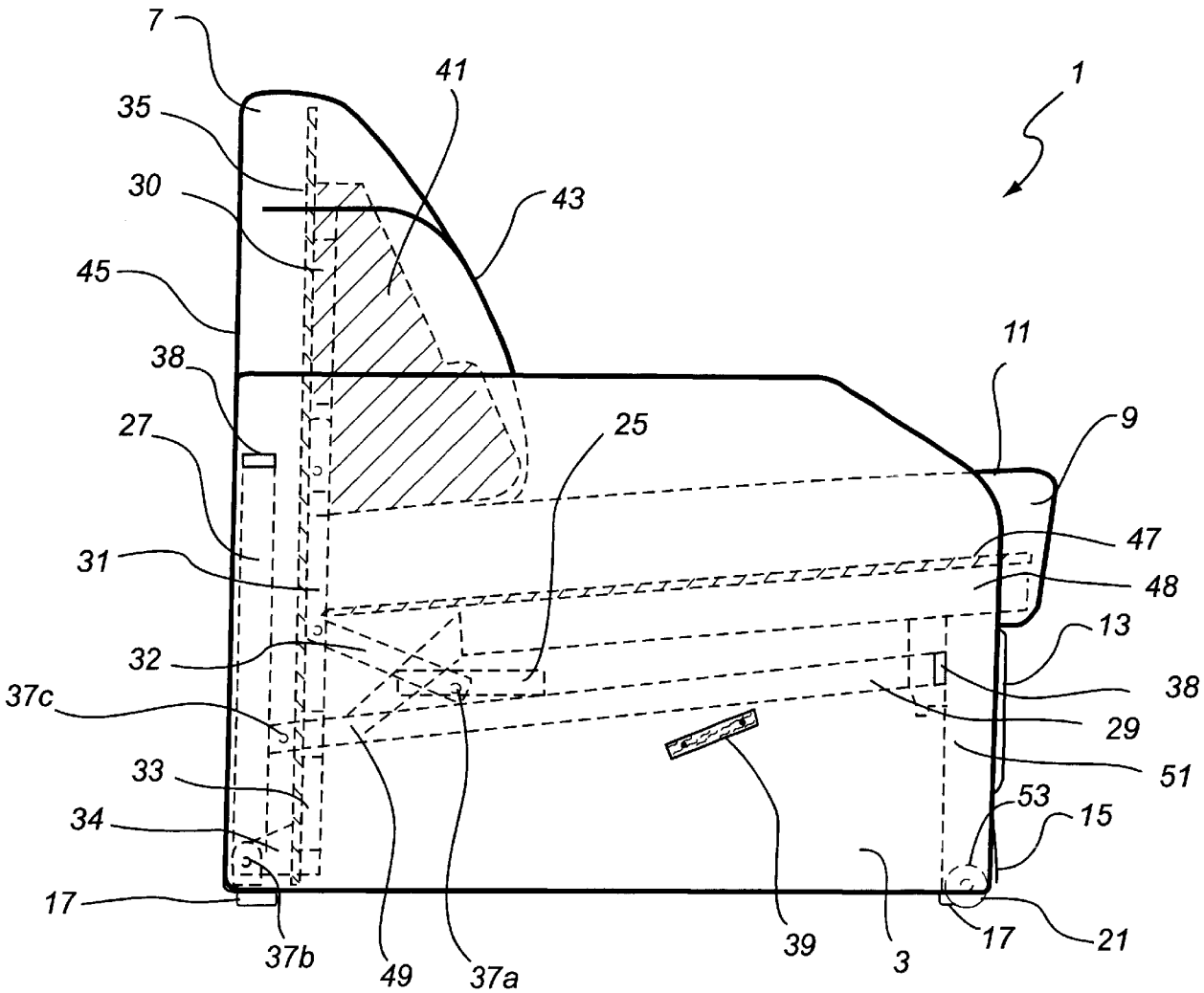
FIG. 2 shows schematically and as an example a side view of the sofa bed according to the invention, in which view the parts invisible to eye are shown in broken line.
Figure 3:
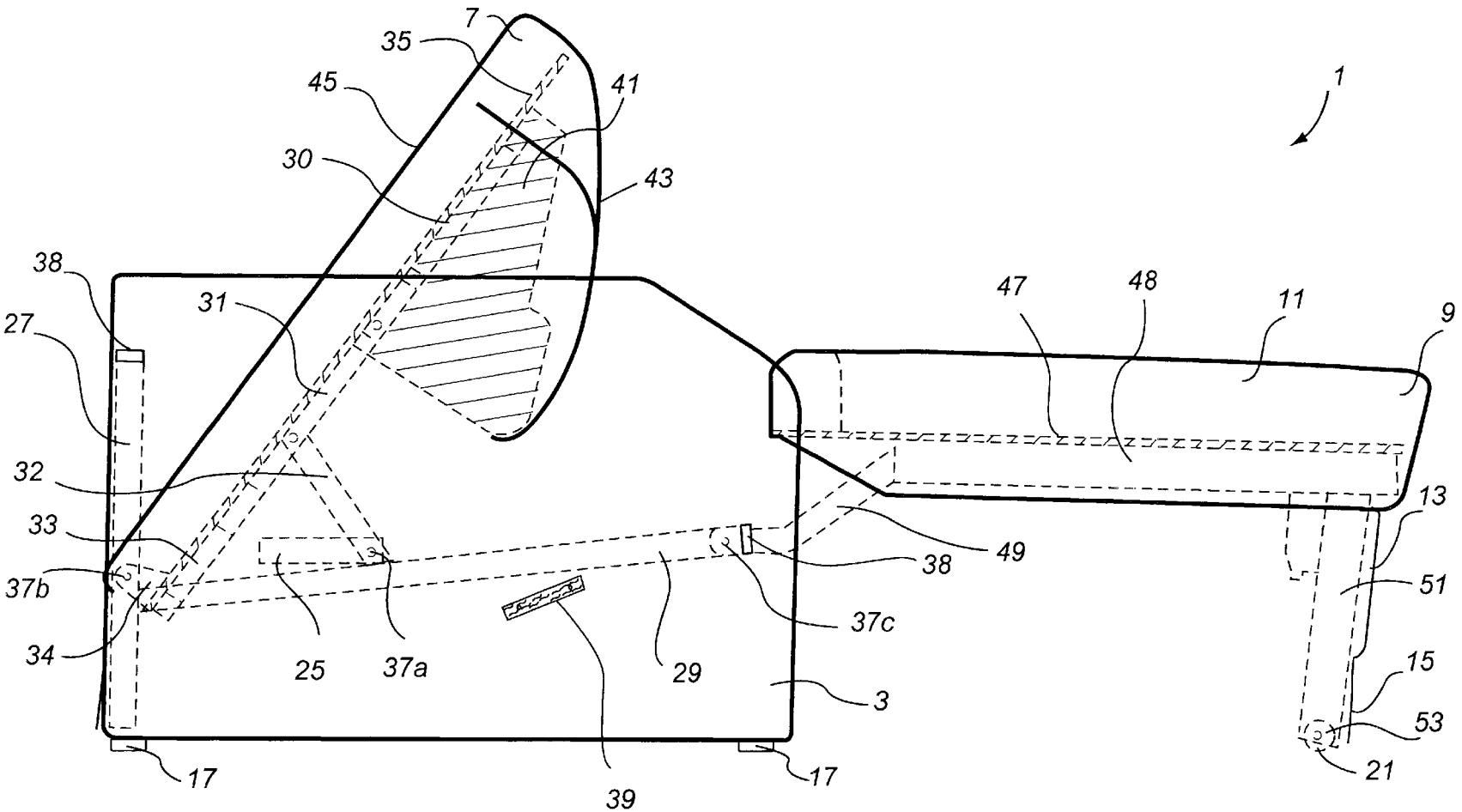
FIG. 3 shows the sofa bed of the FIG. 2 during the opening of the sofa to bed position.
Figure 4:
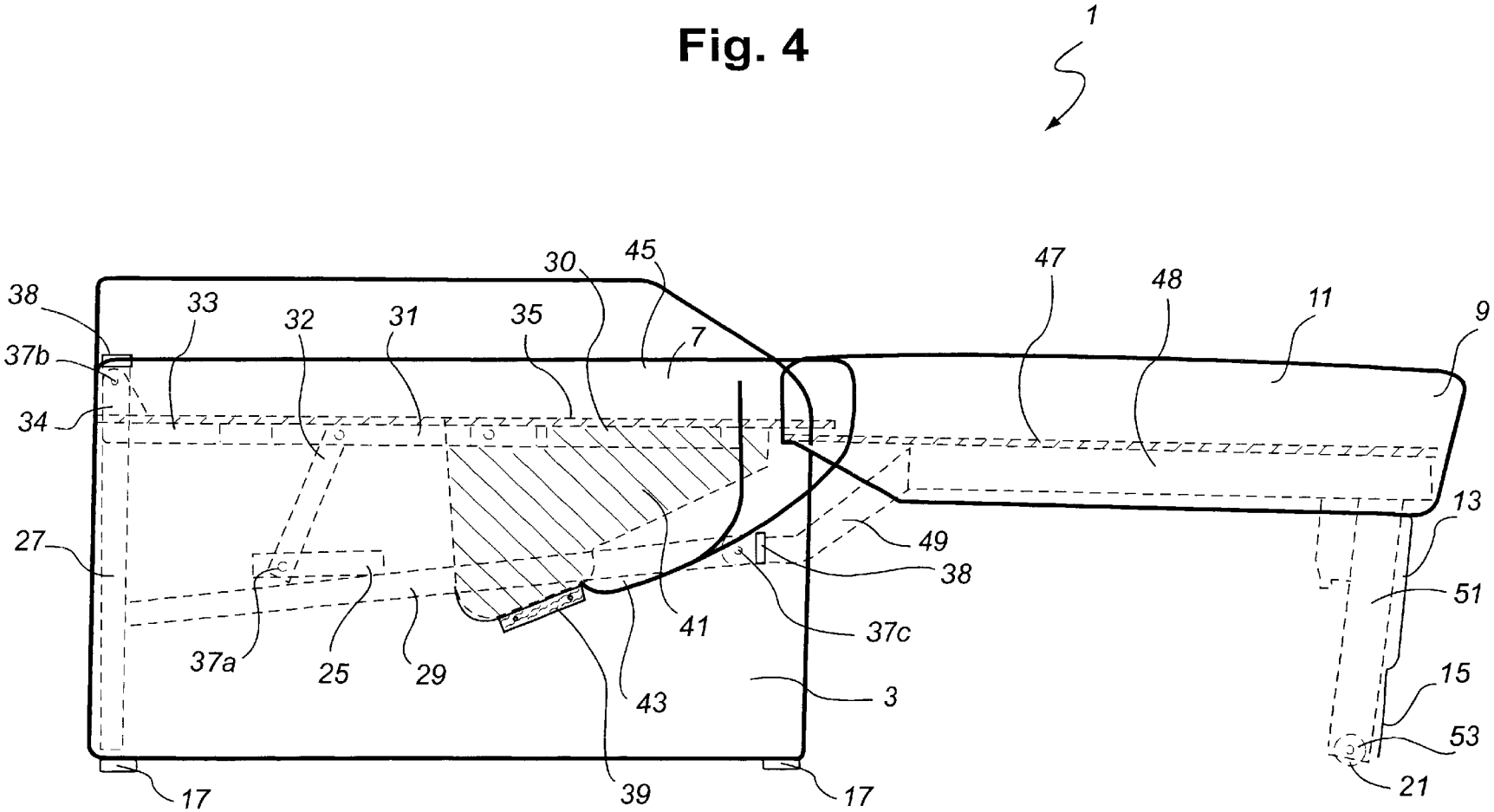
FIG. 4 shows the sofa bed of the FIG. 2 opened.

According to what is shown in FIGS. 2, 3 and 4, a turning guide 25, a directing guide 27 and an opening guide 29 of the sitting section are located in the end section 3 of the frame, as well as in the other end section 5 of the frame as shown in FIG. 1. The guides 25, 27 and 29 are made of metallic C bar, but also other kinds of elements can serve as guides, such as, e.g., grooves in a wood plate or various tubular elements. Guides can also be made of other material, such as, e.g. plastic or aluminum. The back section 7 is connected to the frame via the turning support element 31 and the directing support element 33 attached to a support 30 of the back section which turning support element and directing support element are attached to an inner plate 35 of the back section 7. At the ends of the supporting arms 32 and 34 of the turning support element 31 and directing support element 33 there are axeled rolls 37*a* and 37*b* that are arranged movably in the turning guide 25 and the directing guide 27 and which, in addition, make it possible for the support elements 31 and 33 to rotate around the rolls 37*a* and 37*b* the axis serving as a turning point. The ends of the guides 25 and 27 can be blocked, e.g. by plugging, e.g., the bottom end of the directing guide 27 can be plugged with the support element 17 of the frame and the upper end with a plastic plug, in which case the above-mentioned blocking mechanism can function as an overrunning stop 38 of the movement of the support elements 31 and 33. Also the ends of the opening guide 29 can be blocked with overrunning stops 38 like the ones mentioned.

A preferably upholstered limiter 39 is attached inside the end section 3, against which limiter a collapsible back section 7 presses, all the way to the supporting structure 41 located preferably inside the back section 7. Around the supporting structure 41 and the inner plate 35 of the back section are cushions at the front side 43 serving as a back rest of the back section 7 and at the back side 45 serving as a bed surface.

Below the seat cushions 11 of the seating section 9 is a support plate 47 and a support part 48 of the seating section to which is attached the opening support element 49 arranged movably in the opening guide 29 attached to the end section 3 of the frame. In the end section of the opening support element 49, is an axeled roll 37*c*, which is arranged movably in the opening guide 29 thus, in addition, making it possible for the opening support element 49 to rotate around the axis. The opening guide 29 is mounted ascendingly in the direction of the front edge of the seating section 9 in which case the seating section 9 is inclined in the sofa position, but pulled out in the bed position the seating section 9 moves substantially to a horizontal position.

The support leg 21 of the seating section 9 comprises an arm 51 and a wheel 53 connected to the arm 51, which facilitates moving of the seating section. The length of the support leg 21 is such, that the height of the front edge of the seating section 9 is suitable for its users. The support leg 21 can, if desired, be provided with a height control of the support leg, by means of which the tilt angle of the seating section 9 can be changed when necessary.

The opening of the sofa bed 1 from the sofa position to the bed position is performed in the following manner. The seating section 9 is pulled outwards so that the roll 37*c* of the opening support element 49 slides in the opening guide 29 until it reaches the overrunning stop 38. Thus, the back side of the seating section 9 has risen to a right level and the surface of the seating section is substantially in horizontal position. A locking element or a fitting lock can be connected to the seating section 9, which locking element or fitting lock opens when pulling out the seating section 9 when lifting up the front of the seating section 9, after which seating section 9 can be pulled out in the above mentioned manner. After this the turning of the back section 7 is started. While turning the back section 7, the roll 37*b* of the second turning point ascends upwards the directing guide, the roll 37*a* of the first turning point moving simultaneously forward towards the seating section 9. At the same time, the axes of the rolls allow the back section 7 to turn around the turning points travelling in the guides 25 and 27. After a certain deflection angle, the second turning point still ascending, the first turning point changes its travelling direction. The back section 7 is stopped to a right position by means of the limiter 39, against which the back section 7 is pressed. After opening, the cushioned back side 45 of the back section is next to the seating section 9 and the surface formed this way can be used as a bed. The folding of the sofa bed 1 is performed in the opposite order.

Figure 5:
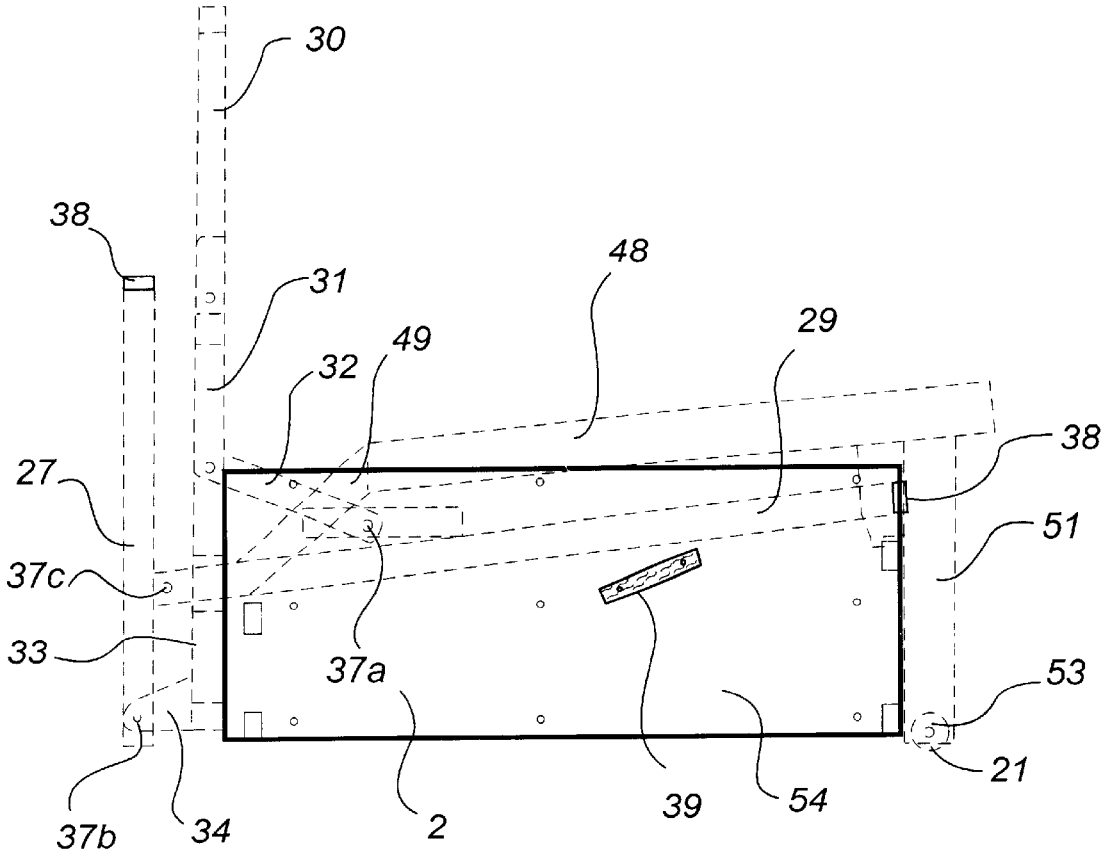
FIG. 5 shows as an example the functional parts located inside the sofa according to the invention.

The FIG. 5 shows the functional parts located inside the sofa bed according to the invention. These parts include a case-like body 2, of which can be seen a case section 54, turning guide 25 of the back section, turning support element 31 attached to the support 30 of the back section and roll 37*a* of the turning support element 31 arranged movably in the turning guide, directing guide 27 of the back section, directing support element 33 attached to the support 30 of the back section and a roll 37*b* of the directing support element 33 arranged movably in the directing guide, and opening guide 29 of the seating section, opening support element 49 attached to the support 48 of the seating section and roll 37*c* of the opening support element 49 arranged movably in the opening guide. In addition, the Figure shows the overrunning stops 38 connected to the end of the guides and the rolling limiter 39 of the back section. Furthermore, the Figure shows the arm 51 of the front of the seating section and the wheel 53 connected to the arm 51. The case section 54 can be used, e.g. for stowage of the bedclothing, and the bottom of it can be perforated to render the cleaning through the bottom plate of the case section 54 by pulling first the seating section 9 forward or by turning the seating section 9 upright against the back section.

Figure 6:
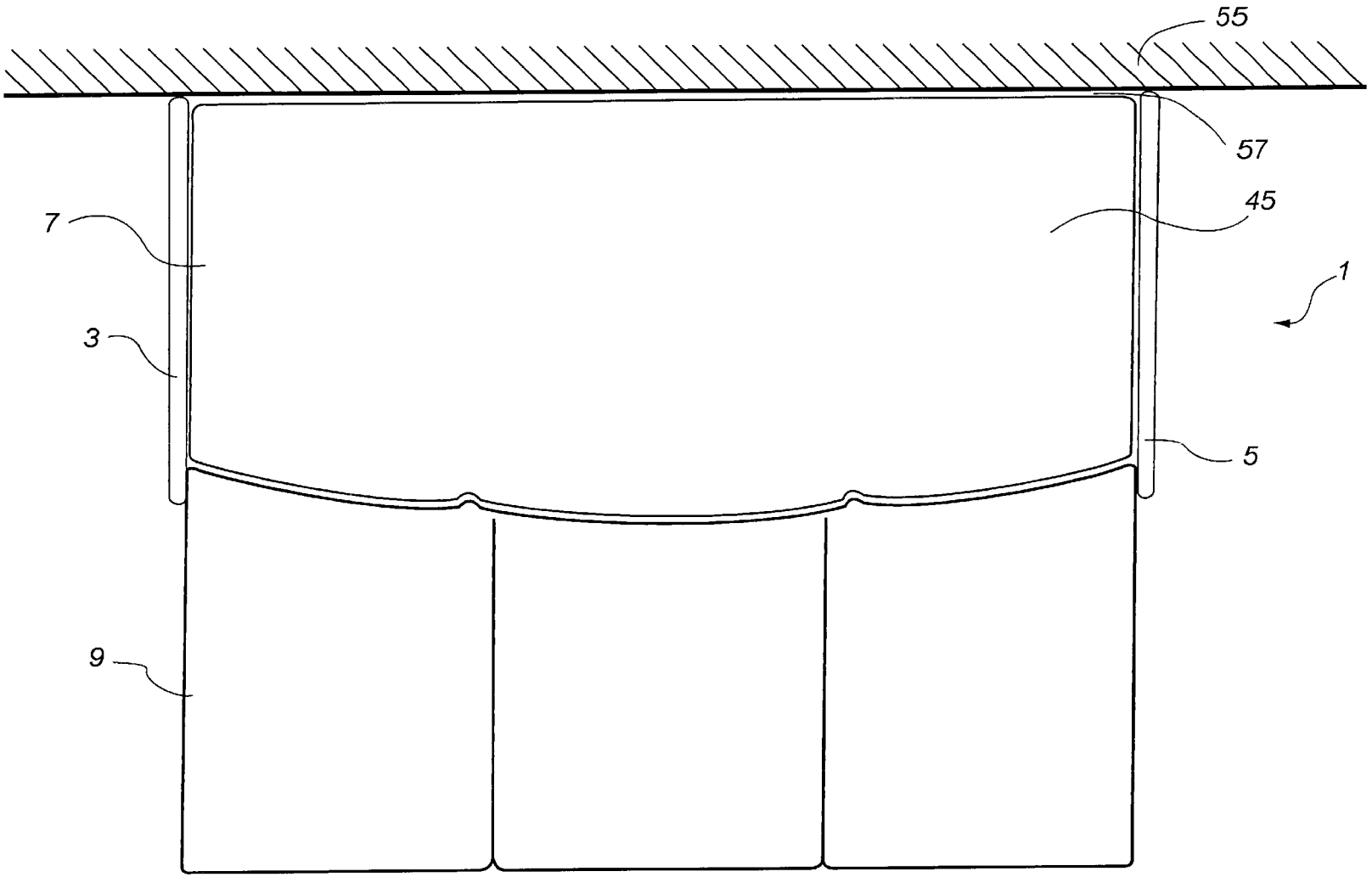
FIG. 6 shows as an example a top view of the sofa bed according to the invention opened and placed next to a wall.

The FIG. 6 shows a sofa bed according to the invention placed next to a wall 55 and opened in a bed position. The bed surface is formed of the sitting section 9 and the back side 45 of the back section 7, the ends of the back section 7 comprising end sections 3 and 5, the height of which can be lower than that of the bed surface.

Figure 7:
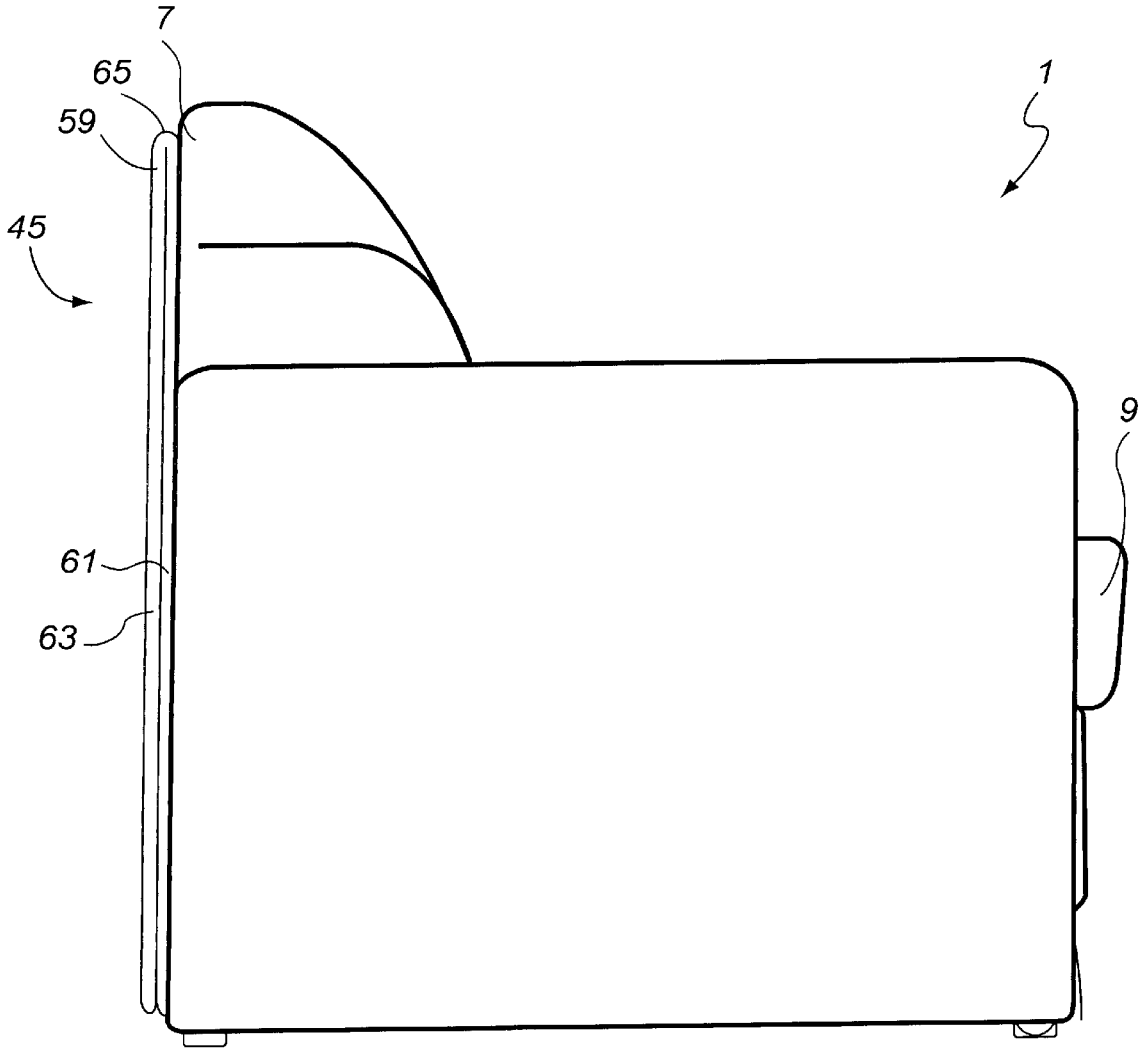
FIG. 7 shows as an example a side view of an embodiment of the sofa bed according to the invention.

The FIG. 7 shows an embodiment of the sofa bed according to the invention, to which sofa bed an overlay mattress 59 is attached. The overlay mattress 59 is folded in the folding point 65 to a first half 61 and to a second half 63. The overlay mattress 59 is attached to the back side 45 of the back section 7 of the sofa bed 1, preferably by means of stickertape, so that the surface of the back side 45 has stickertape to which the stickertape attached to the first side 61 of the overlay mattress 59 sticks. In addition, the first side 61 and the second side 63 are attached together from their edges by means of stickertape. To protect the overlay mattress 59 a vinyl layer that protects from moisture can be mounted on the reverse side of the cloth of the back side. To precipitate making of a bed, a sack-like sheet can be placed around the overlay mattress, which sheet firmly holds around the overlay mattress. After the sofa bed has been opened into a bed position, the fastening between the first half 61 and the second half 63 of the overlay mattress 59 is opened, the fold 65 of the overlay mattress is opened, and the second half 63 of the overlay mattress 59 is turned on the seating section 9.

The invention is not meant to be limited to the embodiments shown above but, on the contrary, the aim is to apply it extensively within the scope of protection defined in the claims below.

What is claimed is:

1. A sofa bed that can be used in a sofa position or a bed position, the sofa bed comprising:

a frame including a turning guide and a directing guide disposed at an angle relative to each other;

a seat section connected to the frame; and a back section pivotally connected to the frame, the back section including a first turning point that is arranged to travel back and forth in the turning guide and a second turning point that is arranged to travel back and forth in the directing guide, wherein the first turning point and the turning guide are relatively positioned such that the first turning point travels back and forth in the turning guide when the sofa bed is shifted from the sofa position to the bed position and travels back and forth in the turning guide when the sofa bed is shifted from the bed position to the sofa position.

2. A sofa bed according to claim 1, wherein the seat section is movably connected to the frame.

3. A sofa bed according to claim 1, wherein the first and second turning points are situated below a seat and bed surface.

4. A sofa bed according to claim 1, further comprising a turning support element connected to the back section, the turning support element including a first supporting arm supporting a first moving member that serves as the first turning point in the turning guide.

5. A sofa bed according to claim 1, further comprising a directing support element connected to the back section, the directing support element including a second supporting arm supporting a second moving member that serves as the second turning point in the directing guide.

6. A sofa bed according to claim 1, further comprising an overrunning stop positioned to limit extreme positions of the back section.

7. A sofa bed according to claim 1, wherein the back section comprises a front-side sofa surface and a back-side bed surface, the back section being arranged to pivot about the first and second turning points so that the back-side bed surface faces upward in the bed position.

8. A sofa bed according to claim 7, wherein the back-side bed surface and the seat section in the bed position comprise a full-size bed surface.

9. A sofa bed according to claim 7, further comprising an overlay mattress attached to the back-side bed surface.

10. A sofa bed according to claim 1, wherein the frame comprises an opening guide, the sofa bed further comprising an opening support element connected to the seat section and movably supporting a roll in the opening guide, the opening guide being inclined upwardly toward a front of the sofa bed.

11. A sofa bed according to claim 1, wherein the second turning point and the directing guide are relatively positioned such that the second turning point travels forth in the directing guide when the sofa bed is shifted from the sofa position to the bed position and travels back in the directing guide when the sofa bed is shifted from the bed position to the sofa position.

12. A sofa bed that can be used in a sofa position or a bed position, the sofa bed comprising:

a frame including a turning guide and a directing guide disposed at an angle relative to each other and an opening guide;

a seat section connected to the opening guide of the frame via an opening support element; and a back section pivotally connected to the frame, the back section including a first turning point that is arranged to travel back and forth in the turning guide and a second turning point that is arranged to travel back and forth in the directing guide, wherein the opening support element movably supports a roll in the opening guide, the opening guide being inclined upwardly toward a front of the sofa bed.

13. A sofa bed according to claim 12, wherein the second turning point and the directing guide are relatively positioned such that the second turning point travels forth in the directing guide when the sofa bed is shifted from the sofa position to the bed position and travels back in the directing guide when the sofa bed is shifted from the bed position to the sofa position.

* * * * *

UNITED STATES PATENT AND TRADEMARK OFFICE

CERTIFICATE OF CORRECTION

PATENT NO. : 6,341,392 B1
DATED : January 29, 2002
INVENTOR(S) : Mäkinen

It is certified that error appears in the above-identified patent and that said Letters Patent is hereby corrected as shown below:

Title page,
Item [57], ABSTRACT, should read:

-- A sofa bed can be used in sofa position and in bed position. The sofa bed includes a frame with end sections, a seating section connected to the frame, and a back section, which is pivotally connected to the frame in at least two turning points. The back side of the sofa at the end sections includes a turning guide and a preferably upwards orienting directing guide and which turning guide and directing guide are generally elongated in form and substantially at an angle with each other. A first turning point is arranged to travel back and forth via the turning guide, and a second turning point in cross direction in a distance from the first turning point is arranged to travel back and forth via the directing guide in order to change the position of the back section between the sofa position and bed position and to turn the back side of the back section upwards. --

Signed and Sealed this

Thirteenth Day of August, 2002

*Attest:*

*Attesting Officer*

JAMES E. ROGAN
*Director of the United States Patent and Trademark Office*